United States Patent [19]

Uihlein et al.

[11] Patent Number: 4,542,604

[45] Date of Patent: Sep. 24, 1985

[54] APPARATUS FOR STORING A PLURALITY OF SIGNS AND AUTOMATICALLY DISPLAYING SAID SIGNS AT PREDETERMINED TIMED INTERVALS

[75] Inventors: Robert E. Uihlein, Uniondale; Walter C. Severson, East Meadow, both of N.Y.

[73] Assignee: Signs by Severson Rend A Sign, Inc., Uniondale, N.Y.

[21] Appl. No.: 601,942

[22] Filed: Apr. 19, 1984

[51] Int. Cl.[4] ..... G09F 11/02

[52] U.S. Cl. ..... 40/475; 40/473; 40/111

[58] Field of Search ..... 40/473, 475, 470, 377, 40/389, 463, 466

[56] References Cited

U.S. PATENT DOCUMENTS 1,914,597 6/1933 Dobrowsky ..... 40/475
4,215,511 8/1980 Todokoro ..... 40/475
4,407,084 10/1983 Uihlein et al. ..... 40/475

*Primary Examiner*—Gene Mancene
*Assistant Examiner*—Wenceslao J. Contreras
*Attorney, Agent, or Firm*—Michael I. Kroll

[57] ABSTRACT

An improved apparatus for storing a plurality of signs and automatically displaying them at timed intervals of the type that has a pair of discs, each disc affixed to opposite ends of an elongated shaft, a plurality of panels, each panel has a copy placed on each side, pivotally mounted off center at each end, around periphery of the discs so they can be displayed when they reach a front display area in a rectangular box-like housing is provided. The improvement consists of a pair of damping devices and a plurality of elongated pins. Each damping device is mounted within the housing adjacent one disc. Each pin is placed on each side of each panel. When the discs turn, each pin will engage one damping device as each panel falls over to prevent each panel from bouncing up.

1 Claim, 11 Drawing Figures

APPARATUS FOR STORING A PLURALITY OF SIGNS AND AUTOMATICALLY DISPLAYING SAID SIGNS AT PREDETERMINED TIMED INTERVALS

BACKGROUND OF THE INVENTION

1. Field of Invention

The instant invention relates generally to display signs and more specifically the invention relates to an improved apparatus for storing a plurality of signs and automatically displaying the copy at timed intervals. The invention is designed to prevent the free fall of panels, thereby making operation of the apparatus smoother in appearance and eliminating noise caused by the panels upon contact against discs within the apparatus at an end of a cycle of rotation. The improved apparatus is an improvement over U.S. Pat. No. 4,407,084.

2. Description of the Prior Art

Numerous display signs have been provided in prior art that are adapted to display a plurality of advertisements following a sequence. For example U.S. Pat. Nos. 1,049,356; 1,077,885; 1,831,962; 3,402,490; 3,696,358; 3,965,592 and 4,117,474 all are illustrative of such prior art. While these units may be suitable for the particular purpose to which they address, they would not be suitable for the purposes of the present invention as heretofore described.

SUMMARY OF THE INVENTION

A principal object of the present invention is to provide an improved apparatus for storing a plurality of signs and automatically displaying them at timed intervals that will eliminate noise caused by a panel falling against discs within the apparatus at an end of a cycle movement.

Another object is to provide an improved apparatus for storing a plurality of signs and automatically displaying them at timed intervals that utilizes a pair of damping devices mounted within the apparatus, each adjacent a disc to prevent each panel from bouncing up.

An additional object is to provide an improved apparatus for storing a plurality of signs and automatically displaying them at timed intervals wherein each damping device contains three different spring loaded adjustable cams to make operation of the apparatus smoother in appearance.

A further object is to provide an improved apparatus for storing a plurality of signs and automatically displaying them at timed intervals that is simple and easy to use.

A still further object is to provide an improved apparatus for storing a plurality of signs and automatically displaying them at timed intervals that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
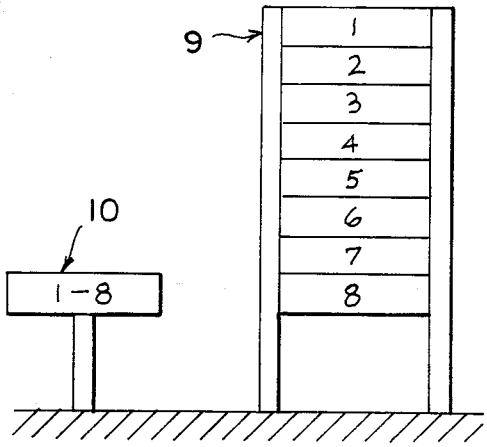
FIG. 1 is a front diagrammatic view of the apparatus next to a standard sign of the prior art.

Turning now descriptively to the drawings, in which similar reference characters denote similar elements throughout the several views, FIGS. 1 through 7 illustrates an improved apparatus 10 for storing a plurality of signs and automatically displaying them at timed intervals. FIG. 1 shows the improved apparatus 10 along side an old sign 9. The improved apparatus can hold one through twelve different signs in a small area while the old sign 9 has signs displayed all at one time which takes up twelve times the space as the improved apparatus 10.

Figure 2:
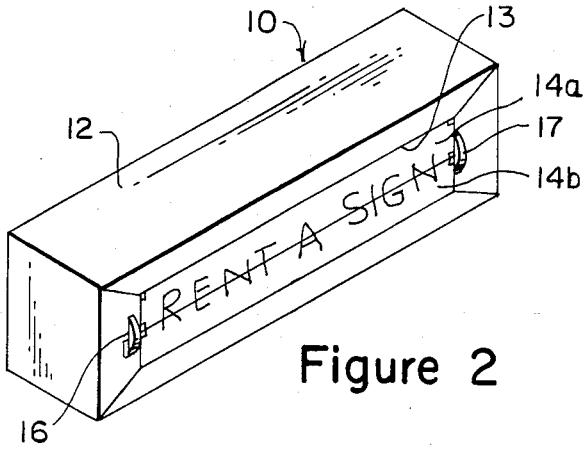
FIG. 2 is a front perspective view of the apparatus.

FIG. 2 shows the improved apparatus 10 has a rectangular box-like housing 12 with a front window display area 13 and two panels 14*a* and 14*b* in a proper vertical position in the front window display area 13 for viewing.

Figure 3:
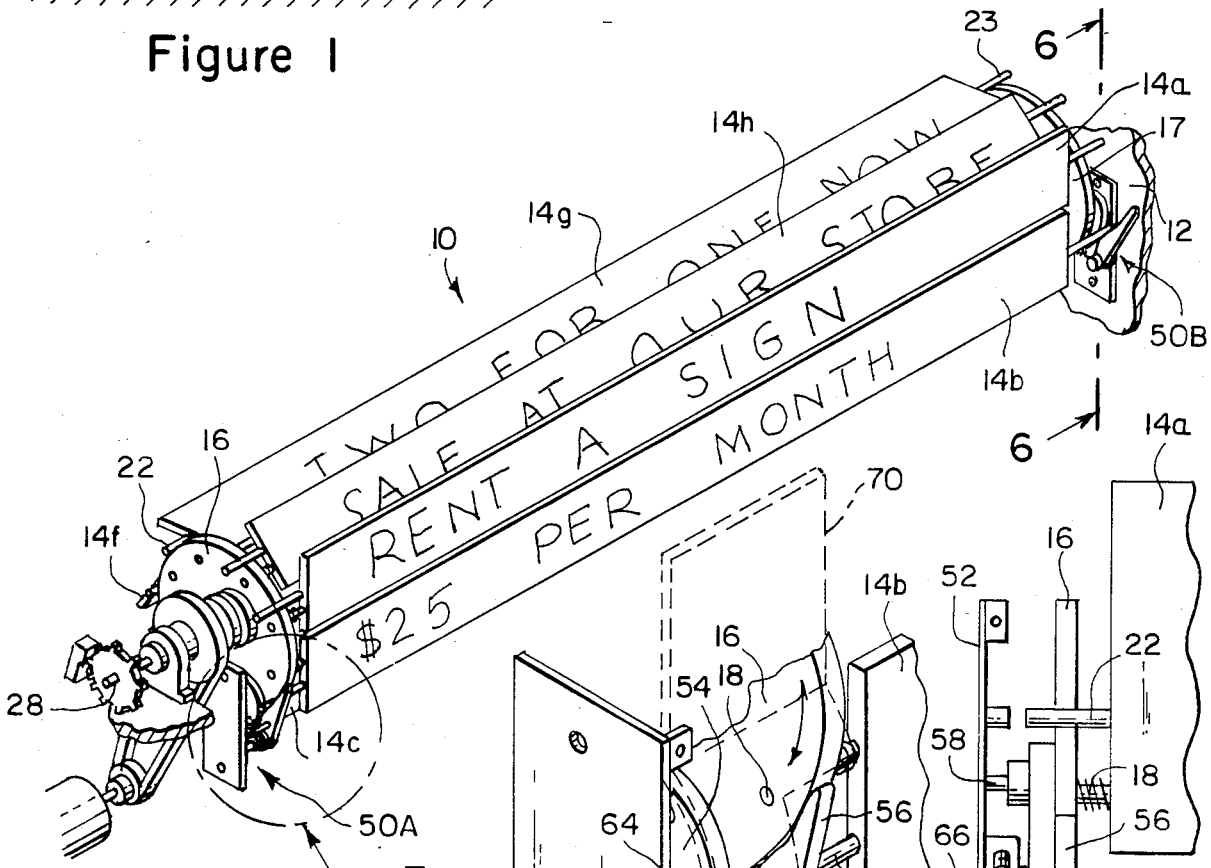
FIG. 3 is a front perspective view of the apparatus with the housing and some parts removed showing the invention in place.
Figure 4:
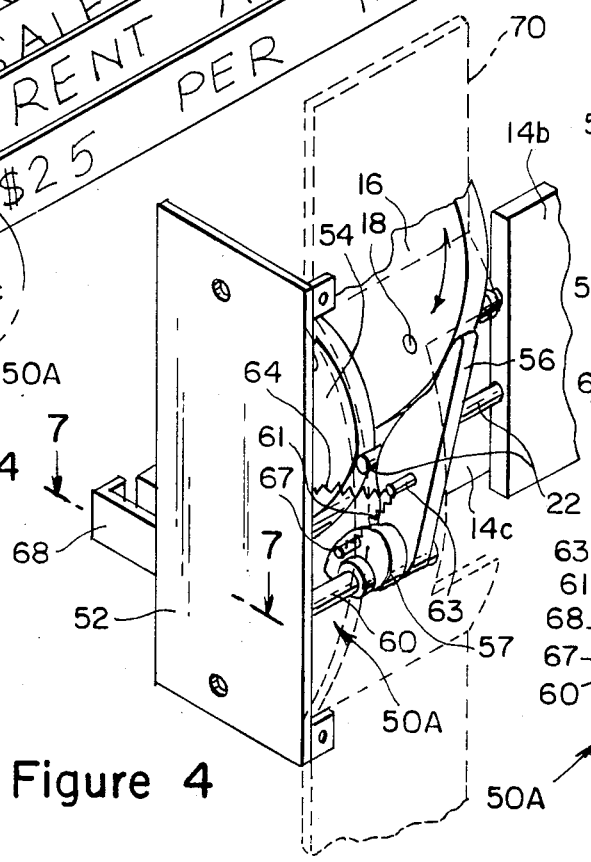
FIG. 4 is an enlarged front perspective view as indicated by circle 4 in FIG. 3 of the left damping device.
Figure 5:
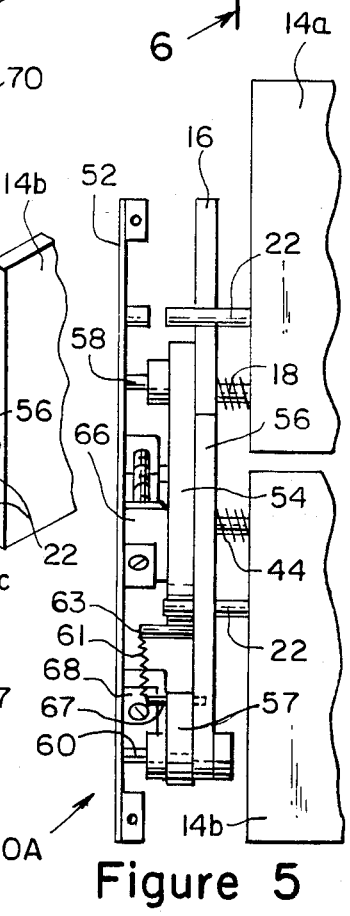
FIG. 5 is an enlarged front view of the left damping device as shown in FIG. 4.

FIG. 3 shows the improved apparatus 10 of the type that has a pair of discs 16, 17 affixed to opposite ends of an elongated shaft 28 and a plurality of panels 14*a* to 14*h*. Each panel has a copy placed on each side and is pivotally mounted off center at each end 18, 19 around periphery of the discs 16, 17 so they can be displayed when they reach the front display area 13 in the rectangular box-like housing 12.

The instant invention is the improvement which consists of a pair of damping devices 50A and 50B and a plurality of elongated pins 22 and 23. The left damping device 50A is mounted within the housing 12 adjacent the left disc 16 while the right damping device 50B is mounted within the housing 12 adjacent disc 17. Each pin 22 is placed on left side of each panel 14*a* to 14*h* while each pin 23 is placed on right side of each panel 14*a* to 14*h*. When the discs 16 and 17 turn each pin 22 and 23 will engage the damping devices 50A and 50B as each panel falls over to prevent each panel from bouncing up.

Each damping device 50A and 50B consists of a mounting plate 52, three different spring loaded cams 54, 56 and 57 and a modesty panel 70. The mounting plate 52 is affixed to a side portion of the housing 12. The three cams 54, 56 and 57 are pivotally affixed to the mounting plate 52 to make operation of the apparatus 10 smoother in appearance as the discs 16 and 17 rotate. The modesty panel 70 (shown in phantom in FIG. 4) is transversely affixed to the mounting plate 52 to cover the cams 54, 56 and 57 when the damping device is mounted within the housing 12 of the apparatus 10.

The first cam member 54 is designed to make contact with elongated pin 22 or 23 on the panel as the discs 16 and 17 rotate. The second cam member 56 is designed to make contact with edge of disc 16 or 17 and wedge the elongated pin 22 or 23 between the second cam member 56 and the first cam member 54 as the discs 16 and 17 rotate. The third cam member 57 is designed to make contact with a second elongated pin 22 or 23 on a second panel that has gone past the first and second cam members 54 and 56. The second panel will be prevented from swinging back and forth hitting other panels.

Figure 7:
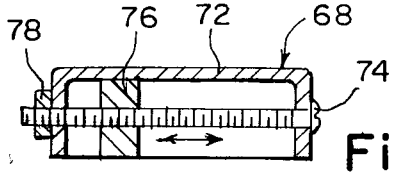
FIG. 7 is a cross sectional view of spring tension adjustment member taken along line 7—7 in FIG. 4.

The first cam member 54 and the second cam member 56 are each adjustably spring loaded by a spring tension adjustment member 66 or 68. FIG. 7 shows adjustment member 68 which has the same components as adjustment member 66 and will be described as follows. Adjustment member 68 has a U-shaped housing 72, a threaded bolt 74 that engages a threaded aperature in an adjustable plate 76. A nut 78 is provided at free end of bolt 74 for locking adjustment member 68.

A spring 64 is connected between plate 76 on adjustment member 68 and pin 63 on second cam member 56 while a spring 62 is connected between plate 76 on adjustment member 66 and pin 65 on first cam member 56 so that tension can be increased and decreased accordingly. A small spring is connected between pin 67 on the third cam member 57 and pin 63 on cam member 56. First cam member 54 pivots on shaft 58, while second cam member 56 and third cam member 57 both pivot on same shaft 60 on mounting plate 52.

To best understand operation of damping devices 50A and 50B FIGS. 6A to 6E are referred to showing right damping device 50B which is identical to damping device 50A and operates in the same manner.

Figures 6A, 6B, 6C, 6D, 6E:
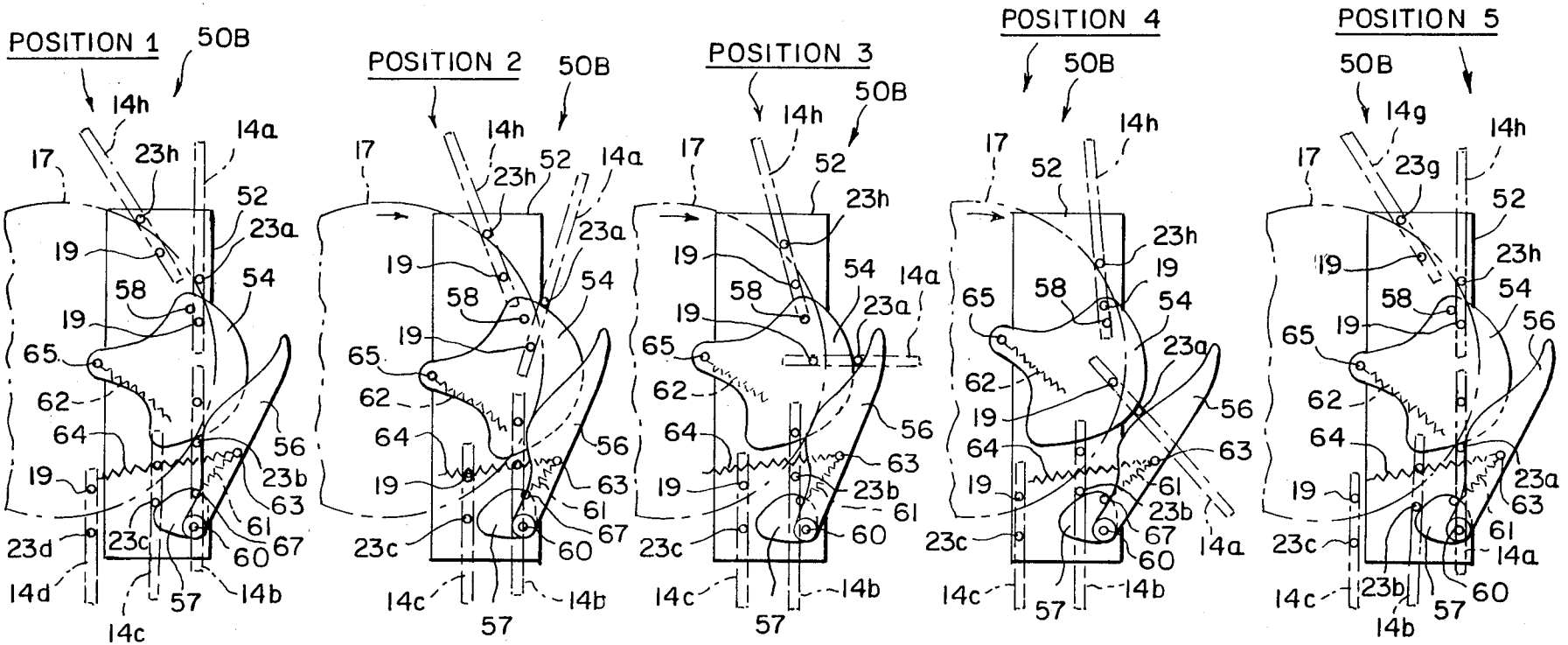
FIGS. 6A through 6E show simplified side views as indicated by line 6—6 in FIG. 3 of the right damping device and the right disc and panels in various positions during one cycle of rotation.

FIG. 6A shows position 1 which is the starting position. No motion is taking place.

FIG. 6B shows position 2. As the disc 17 begins to rotate in a forward clockwise motion panel **14*a* begins to fall so that its fall is eased by the first cam member 54. Meanwhile second cam member 56 is resting against edge of disc 17, ready in position to catch pin 23*a* on panel 14*a*. The third cam member 57 is holding panel 14*c* in position to prevent it from swinging into panel 14*b*. The light spring 61 on the third cam member 57 attached to the second cam member 56, allows the third cam member 57 to drop away should panel 14** fail to drop fully through a cycle.

FIG. 6C shows position 3. As panel **14*a* continues to mid fall it is picked up by second cam member 56 which further reduces its speed. Panel 14*b* is allowed to fall free and panel 14*c* is still being held in check by third cam member 57**.

FIG. 6D shows position 4. As panel **14*a* nears end of its fall into reading position, it is slowed to its fullest by the wedging actions of first cam member 54 and second cam member 56, panel 14*b* is beginning to fall in a position against the third cam member 57 and will be prevented from swinging back and forth hitting panels 14*a* or 14*c***.

FIG. 6E shows position 5. Panel **14*a* is now in the reading position. The wedging action of the first cam member 54 and the second cam member 56 has slowed the fall of the panel 14*a* preventing it from hitting the disc 17 and also smoothed the falling action of the panel 14*a* preventing it from going into a swinging motion. The time from starting position 1 in FIG. 6A through cycle to rest position 5 in FIG. 6E**, is approximately one second.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved apparatus for storing a plurality of signs and automatically displaying them at timed intervals of the type having a pair of discs, each said disc affixed to the opposite ends of an elongated shaft and a plurality of panels, each said panel having copy placed on each side, pivotally mounted off center at each end around the periphery of said discs so that they can be displayed when they reach a strong display area in a rectangular box-like housing wherein the improvement comprises:

(a) a plurality of elongated pins, each pin placed on each side of each panel; and (b) a pair of damping devices each of said damping device mounted within said housing adjacent one said disc, said damping device having a mounting plate affixed to a side portion of said housing, three different spring loaded adjustable cams pivotally affixed to said mounting plate to make operation of said apparatus smoother in appearance as said discs rotate, said three different spring loaded adjustable cams having a first cam member that is adjustably spring loaded by a spring tension adjustment member, a second cam member that is adjustably spring loaded by a spring tension adjustment member designed to make contact with the edge of said disc and to wedge said elongated pin between said second cam member and said first cam member as said discs rotate, and a third cam member designed to make contact with said second elongated pin on said second panel that has gone past said first and second cam members so that said second panel will be prevented from swinging back and forth and from hitting the other panels, and a modesty panel transversely affixed to said mounting plate to cover said cams when said damping device is mounted within said housing of said apparatus.

* * * * *